US005509233A

United States Patent [19]

Peterson

[11] Patent Number: 5,509,233

[45] Date of Patent: Apr. 23, 1996

[54] MOTORIZED GARAGE DOOR OPENER UNLOCKING SYSTEM

[76] Inventor: Frank R. Peterson, 4839 E. Gary St., Mesa, Ariz. 85205

[21] Appl. No.: 184,837

[22] Filed: Jan. 21, 1994

[51] Int. Cl.[6] ..... E05F 15/00

[52] U.S. Cl. ..... 49/139; 49/199; 49/280

[58] Field of Search ..... 49/139, 140, 199, 49/200, 280; 160/188, 189

[56] References Cited

U.S. PATENT DOCUMENTS

| | | | |
|---|---|---|---|
| 2,097,950 | 11/1937 | Johnson | 160/189 |
| 2,577,348 | 12/1951 | McLaughlin | 49/200 |
| 2,589,480 | 3/1952 | Curtis | 49/139 X |
| 2,703,235 | 3/1955 | Reamey | 49/280 X |
| 2,982,541 | 5/1961 | Brady | 49/140 |
| 4,827,667 | 5/1989 | Jarvis | 49/280 |
| 4,884,831 | 12/1989 | Emon | 49/280 |
| 4,996,795 | 3/1991 | Niswonger | 49/280 |
| 5,001,861 | 3/1991 | Hahn | 49/280 |
| 5,080,409 | 1/1992 | Niswonger | 292/345 |

*Primary Examiner*—Philip C. Kannan

[57] ABSTRACT

This invention provides an existing garage door locking system with a motorized unlocking system that will unlock the garage door prior to motorized opening, but maintain garage accessability and security with the existing garage door locking system if a power or motorized garage door system failure occurs.

1 Claim, 3 Drawing Sheets

EL DENOTES EXISTING LOCK

EL DENOTES EXISTING LOCK

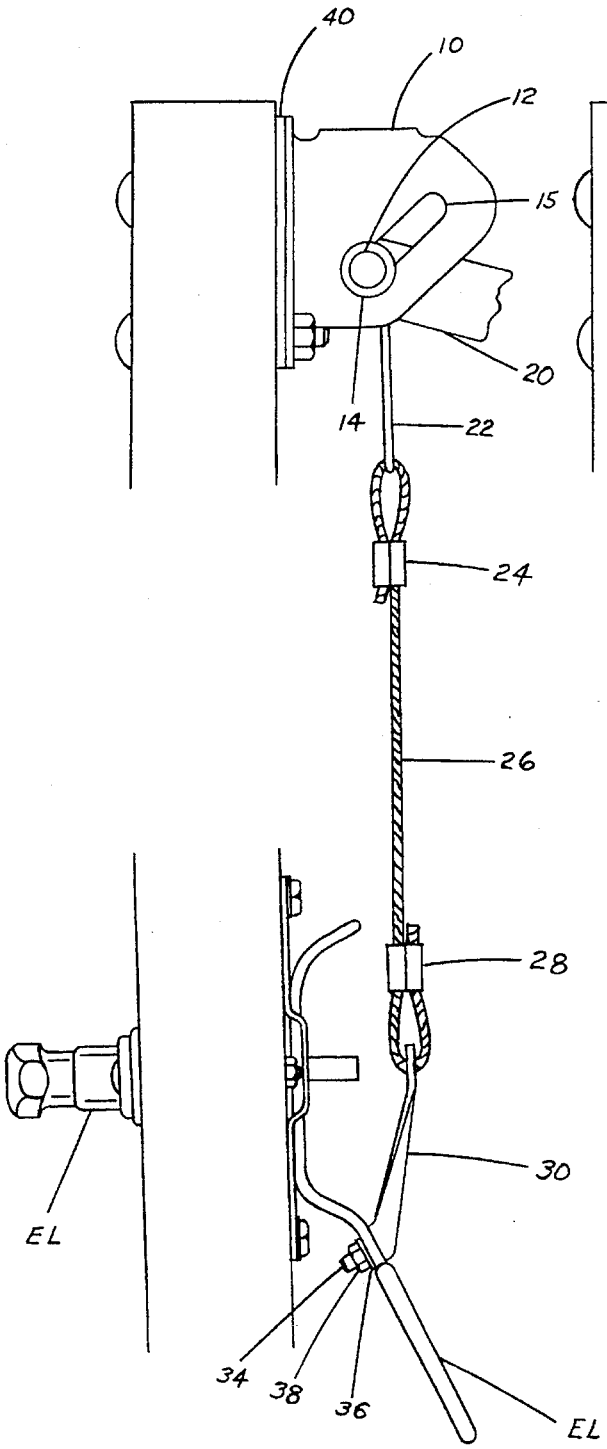
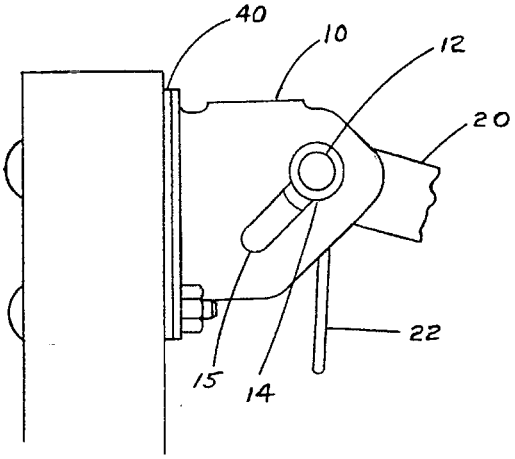
FIG 5
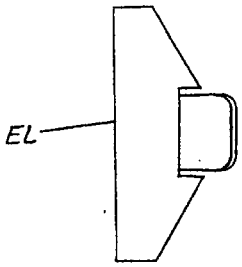
FIG 6
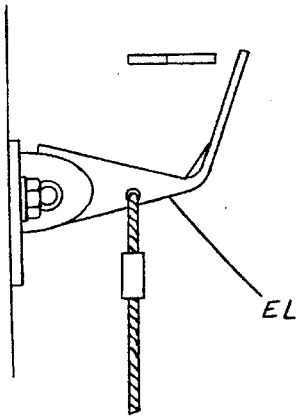
EL DENOTES EXISTING LOCK
FIG 4
FIG 7

MOTORIZED GARAGE DOOR OPENER UNLOCKING SYSTEM

BACKGROUND—FIELD OF INVENTION

This invention relates to a motorized garage door unlocking system that leaves the existing manual locking system operational if the garage door opener fails to operate for any reason.

BACKGROUND—DESCRIPTION OF PRIOR ART

Motorized garage door openers for opening and closing overhead garage doors are well known in the art. Existing manual garage door locking systems are unlatched or completely removed at the time of motorized garage door opener installation. Prior art provides many methods to secure the operational motorized garage door. However, if the primary locking and unlocking device fails—the motorized garage door opener—no alternate manual locking or unlocking means is provided:

U.S. Pat. No. 4,827,667 to JARVIS, May 9, 1989

U.S. Pat. No. 4,884,831 to EMON, Dec. 5, 1989

U.S. Pat. No. 4,996,795 to NISWONGER, Mar. 5, 1991

U.S. Pat. No. 5,001,861 to HAHN, Mar. 26, 1991

U.S. Pat. No. 5,080,409 to NISWONGER, Jan. 14, 1992

None of the aforementioned garage door security mechanisms address a means for alternate locking or unlocking the garage door if a motorized door opener failure occurs, leaving garage security and accessibility in doubt.

OBJECTS AND ADVANTAGES

Accordingly the advantages of this invention allows specific existing garage door locking systems to be unlocked by the motorized garage door opener, but remain in operation if a power failure or motorized door opener system failure occurs. The desired garage access and security is maintained with the manual locking garage door systems previously installed. A garage door locking system that meets the requirements to be used with this invention must have a key operated unlocking handle installed on the exterior center of the garage door at a convenient height for easy accessibility and an interconnecting handle on the interior center of the garage door that can be adapted with an unlock arm—which is part of this invention. Both interior and exterior handles must operate independent of the other, but be capable of unlocking the locking system from their respective positions. The garage door locking system must be spring loaded to the locked position.

This invention will override the existing spring loaded garage door locking system during unlocking and garage door opening with the motorized door opener. If a failure occurs, disconnect the emergency handle on the motorized garage door opener shuttle and stow in the "un-locked" position. The garage door becomes operational in the manual mode and the existing manual locking system remains operational. Access from the exterior by key or egress by the interior unlock handle, maintaining garage security.

Further advantages of this invention will become apparent from a consideration of the drawings and ensuing description.

BRIEF DESCRIPTION OF DRAWINGS

FIG. 4 is an end view of the garage door showing the existing interior and exterior handles and the unlocking assembly added by this invention.

FIG. 5 shows the bracket, yoke and motorized actuation arm in the unlocked position.

FIG. 6 is an end view of an existing spring loaded latch in the unlocked position.

FIG. 7 is a top view of an existing spring loaded latch in the unlocked position.

DETAILED DESCRIPTION OF THE EMBODYMENT

This invention requires a slotted bracket "10" to be mounted near the top interior center of the segmented garage door. If a motorized garage door opener has been previously installed a backing plate "40" may be attached to the bracket "10" with conventional mechanical fasteners (not shown). Thus, the previous bracket mounting bolts may be used. Bracket "10" encloses a yoke "22" and the motorized garage door actuation arm "20". (Yoke "22" and arm "20" are connected by pin "12" which must move freely the length of the parallel slots "15" in bracket "10). Pin "12" is installed with washers "14" and "16" in their respective positions and secured with locking ring "18". The importance of the slots "15" are to give the unlock arm "30" sufficient movement to completely unlock the existing manual garage door locking system. The length of slot "15" will vary with the angle chosen. Bracket "10" and backing plate "40" were made from mild steel.

Figures 1, 2, 3:
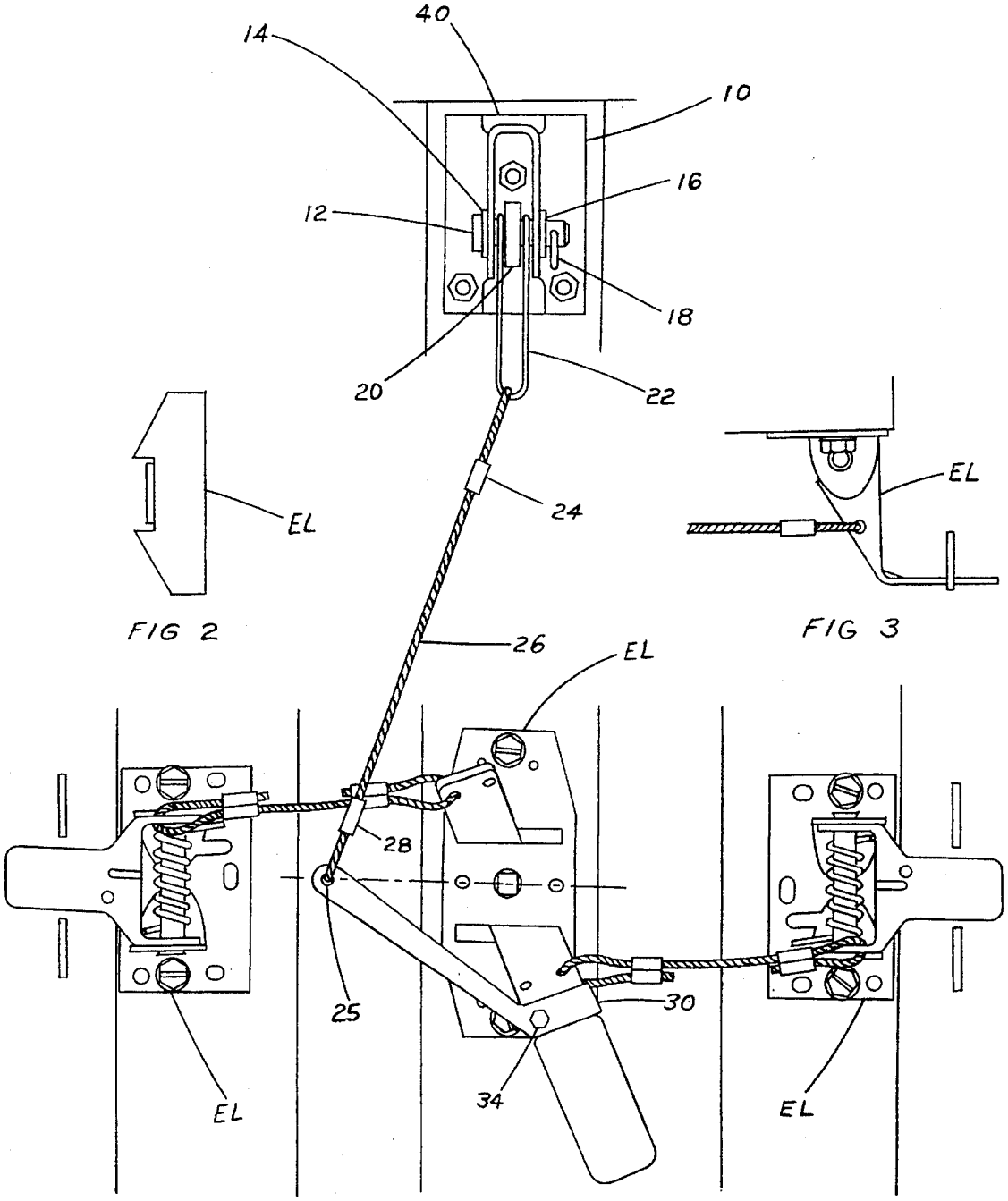
FIG. 1 is a view of an existing spring loaded lock assembly as installed on the interior of a segmented garage door and the unlocking assembly added by this invention.
FIG. 2 is an end view of an existing spring loaded latch in the locked position.
FIG. 3 is a top view of an existing spring loaded latch in the locked position.

Yoke "22" is an important part of this invention. The yoke provides an effective way to connect cable "26" to the motorized garage door actuation arm "20". Since it is necessary to pull cable "26" at an angle from bracket "10" to the cable attach point "25" in unlock arm "30" as shown in FIG. 1. The upper loops of the yoke "22" were made for pin "12". The yoke length is not critical but should provide adequate clearance between the cable "26" and the door mounted bracket "10" during motorized garage door operation. The yoke "22" was made from spring steel wire.

The garage door unlock arm "30" was made from mild steel. The unlock arm "30" was bent 30° in the vertical position along the radius and then twisted to allow the center line of the cable attach hole "25" to be positioned perpendicular to the interior garage door when installed on the interior garage door unlock handle. The 30° vertical bend was made for clearance of the actuation cable "26" and interior garage door hinges. This angle may vary due to clearance requirements of the garage door locking system installed. Also the length of the unlock arm "30" will depend on the slot "15" length and angle chosen in bracket "10". It is recommended that cable attach hole "25" be located horizontal to the interior garage door handle pivot as shown in FIG. 1. The opposite end of the unlock arm "30" has a 90° bend with a short leg. The leg is positioned against the existing interior garage door handle prior to locating hole "35". Hole "35" is for bolt "34" securing the unlock arm "30" to the existing interior handle of the manual garage door locking system with washer "36" and nut "38".

OPERATION

Figure 8:
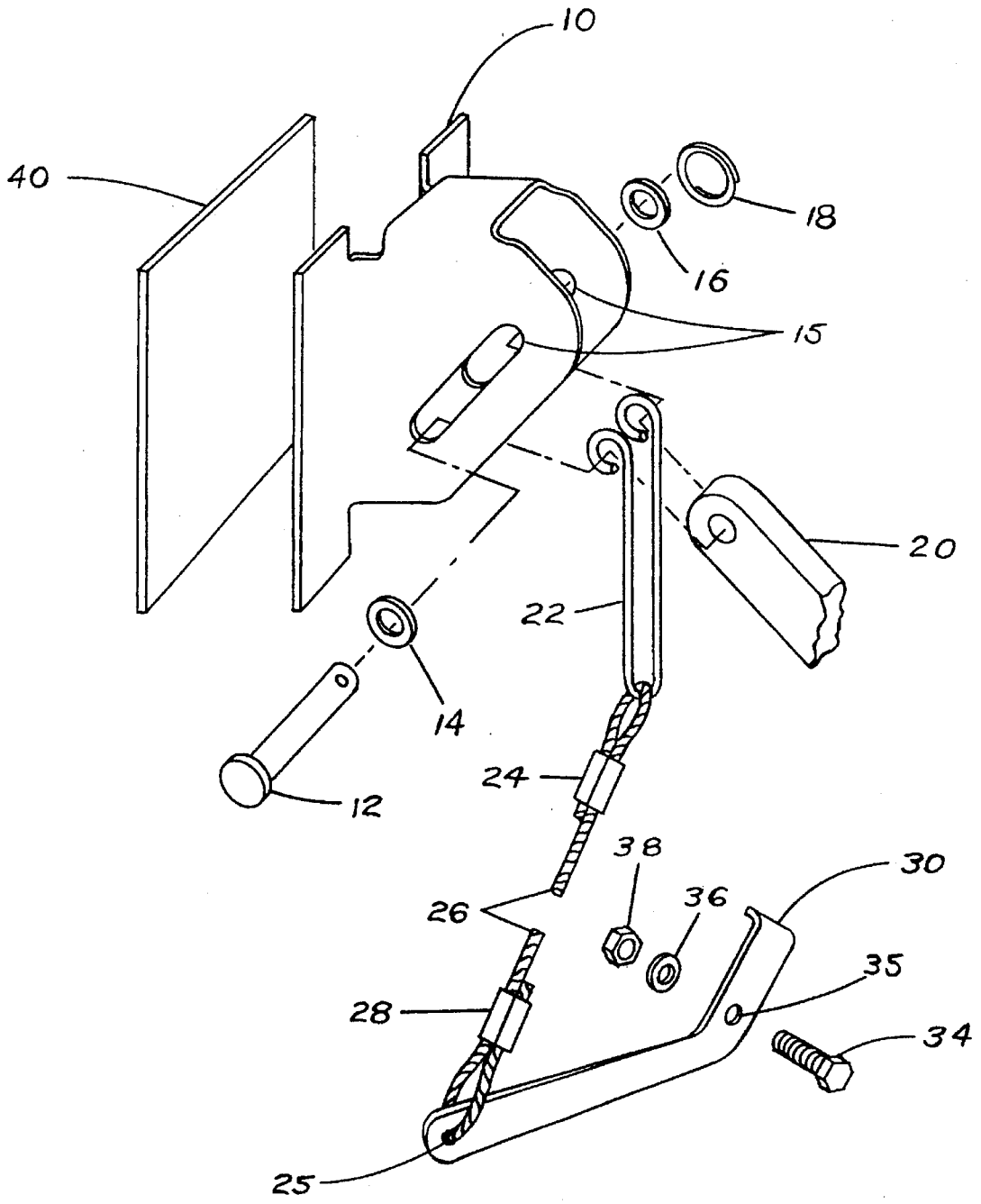
FIG. 8 is an exploded perspective view of the components required for this invention.

To make this unlock system operational—install bracket "10", connect yoke "22" and motorized garage door actuation arm "20" securing with pin "12" per FIG. 8. Install unlock arm on the interior garage door handle as shown in FIGS. 1 and 8. Rig the garage door opener per the manufactures instructions. Run the garage door to the closed and locked position. Install cable "26" between the yoke "22" and hole "25" in unlock arm "30". Secure cable "26" tautly and crimp the aluminum swage sleeves "24" and "28". Upon motorized operation of the garage door, the first movement of the motorized garage door opener to the open position will unlock the garage door locking system and then open the garage door. With the garage door open, the spring loaded locks will position the door actuator arm "20" of the motorized door opener near the bottom of slots "15" on the door mounted bracket "10" and near the locked position. During closing with motorized operation the door lock system will remain in the locked position during the entire operation. Manually locking as the garage door stops in the closed position. Various modifications and changes may be made with regard to the foregoing description without departing from the spirit of the invention.

What is claimed:

1. A garage door unlocking device to be incorporated with an existing spring operated door locking system when an automatic garage door opener is installed, said device comprising; a bracket mounted on the door at the upper edge thereof, said bracket having slotted parallel sides, a pin slidably mounted in the slots and secured therein by a locking ring, said pin connected to and actuated by an operating arm of the automatic garage door opener, a yoke connected to the pin at a first end thereof and attached to one end of a cable at a second end thereof, an actuation arm connected at one end to an interior handle of the existing garage locking system at a distance offset from the center of the existing door handle pivot point, said actuation arm being connected at its other end to the other end of said cable, whereby when the automatic garage door opener is operated, the operating arm moves the pin in the slots which raises the yoke and thereby pulls the cable which moves the actuation arm sufficiently to rotate the handle and release the spring operated locks prior to opening the garage door.

* * *. * *